United States Patent [19]

Van Auken

[11] 4,109,911

[45] Aug. 29, 1978

[54] GAMING SURFACE CONTACT DETECTING SYSTEMS

[76] Inventor: John A. Van Auken, 16 La Gorce Cir., Miami Beach, Fla. 33141

[21] Appl. No.: 787,474

[22] Filed: Apr. 14, 1977

Related U.S. Application Data

[63] Continuation of Ser. No. 570,766, Apr. 23, 1975, abandoned.

[51] Int. Cl.[2] ..... A63B 19/06

[52] U.S. Cl. ..... 273/31; 273/61 R; 200/61.1; 200/61.11; 200/277

[58] Field of Search ..... 273/29 A, 31, 61 R, 273/58 A, 58 G, 58 K, 202.2, DIG. 5; 340/323, 358 C, 258; 200/61.1, 61.11, 277

[56] References Cited

U.S. PATENT DOCUMENTS

| | | | |
|---|---|---|---|
| 3,415,517 | 12/1968 | Krist | 273/29 R |
| 3,774,194 | 11/1973 | Jakay | 273/31 |
| 3,854,719 | 12/1974 | Supran | 273/29 K |
| 3,883,860 | 5/1975 | Kohorn | 273/31 X |

*Primary Examiner*—Richard C. Pinkham
*Assistant Examiner*—T. Brown
*Attorney, Agent, or Firm*—Strauch, Nolan, Neale, Nies & Kurz

[57] ABSTRACT

A gaming surface contact detecting system for detecting the presence of a particular type of projectile upon touchdown of the projectile on any gaming surface or surfaces and for locating the position of touchdown of the projectile in relation to the gaming surface or surfaces. The gaming surface contact detecting system includes a projectile with at least one surface portion of detectable material, and a surface signal means. The surface portion of the projectile may include a contact recognition surface such as a chemical surface or an electrical conductive surface. The surface signal means may include a second chemical surface or may include a sensing means. The surface signal means is connected on at least a portion of the gaming surface. Upon positive contact between the projectile and the surface signaling means, a signal is initiated that signals the touchdown of the projectile that bounces off the surface signaling means on the gaming surface.

6 Claims, 17 Drawing Figures

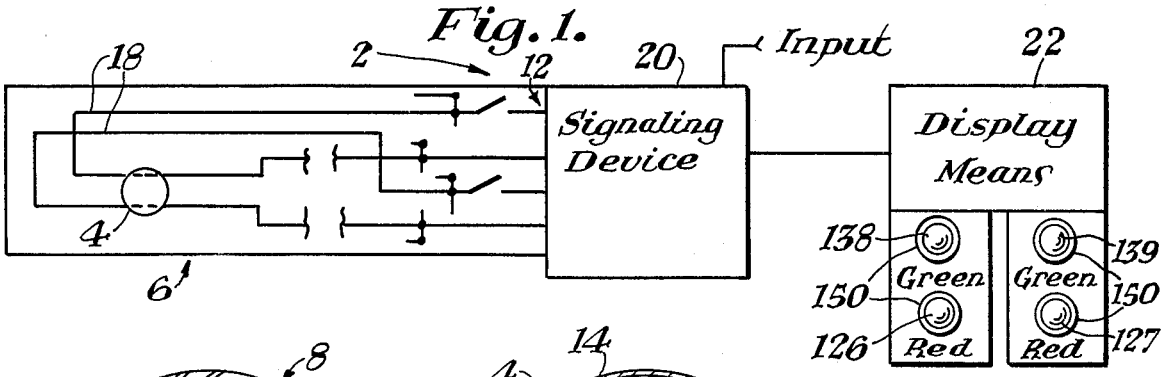
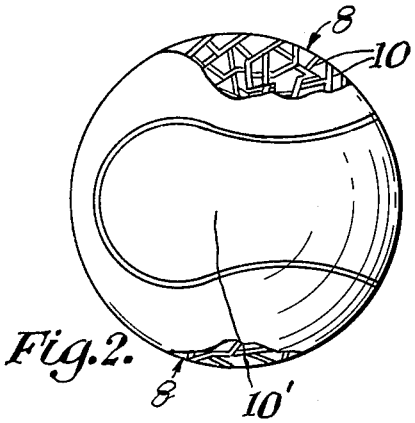
Fig. 2.
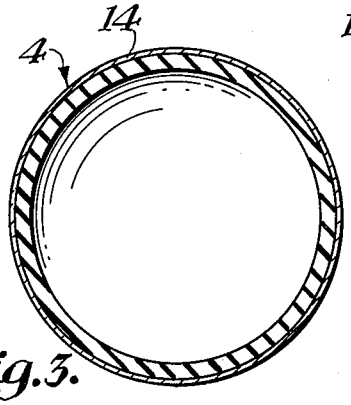
Fig. 3.
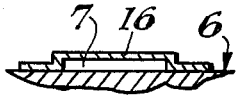
Fig. 4.
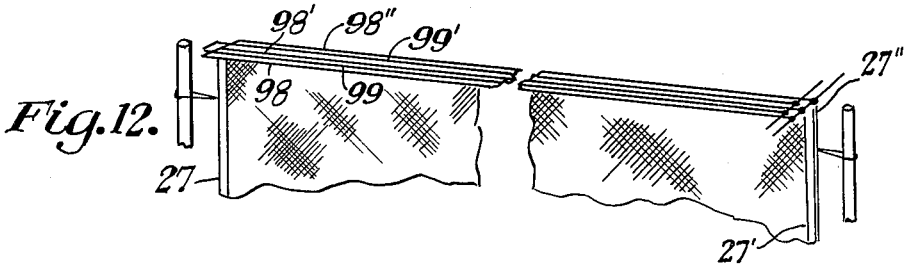
Fig. 12.
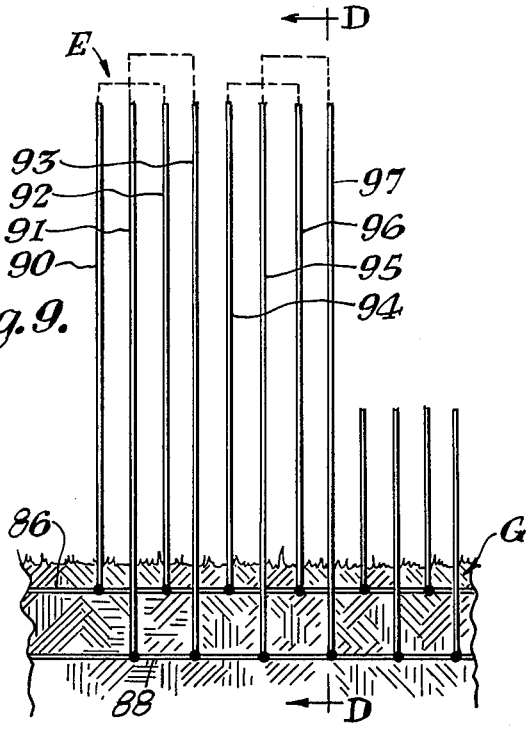
Fig. 9.
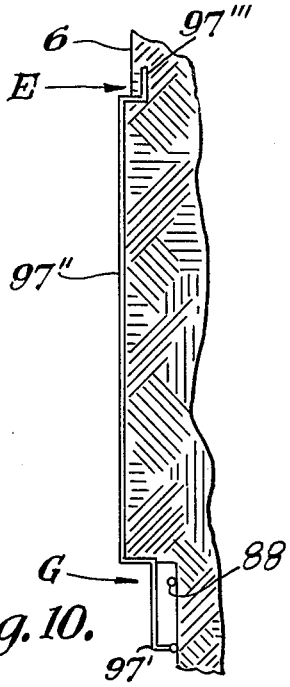
Fig. 10.

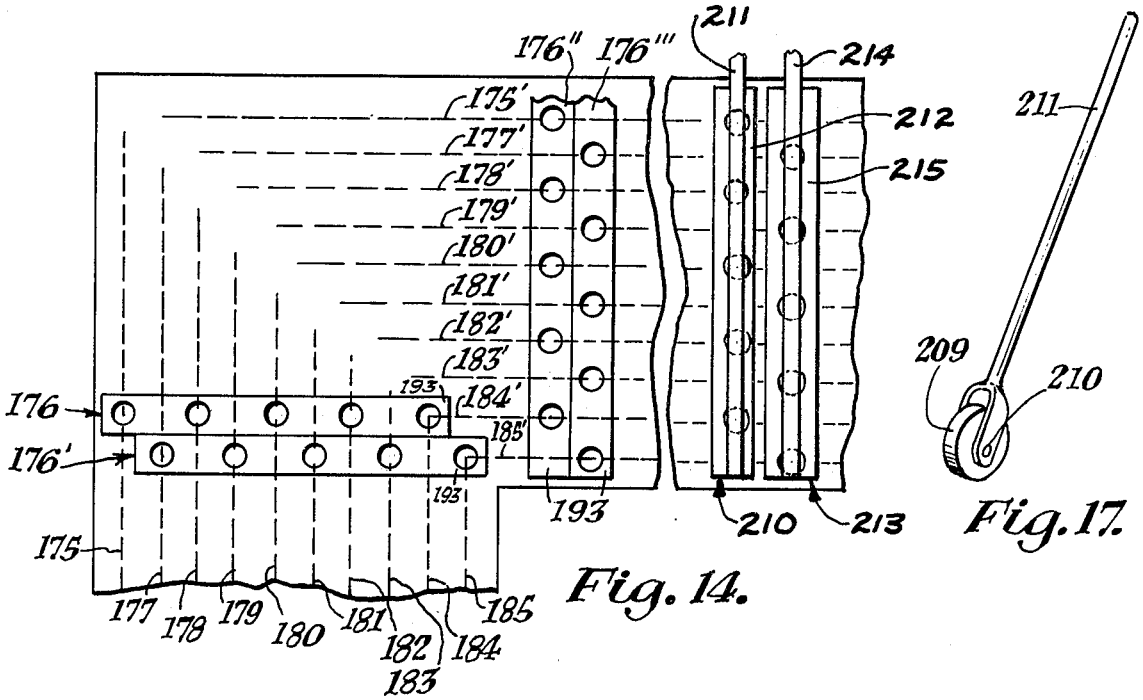
Fig. 14.
Fig. 17.
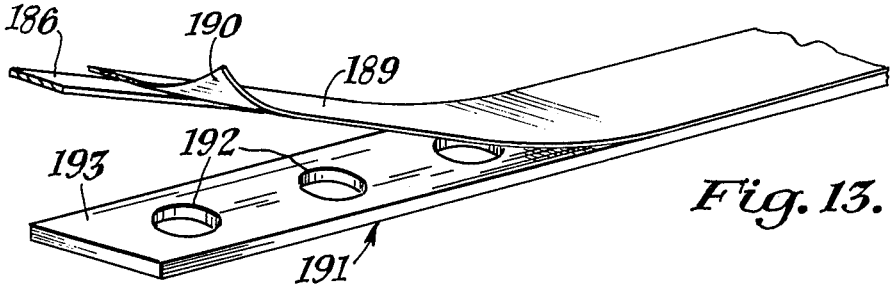
Fig. 13.
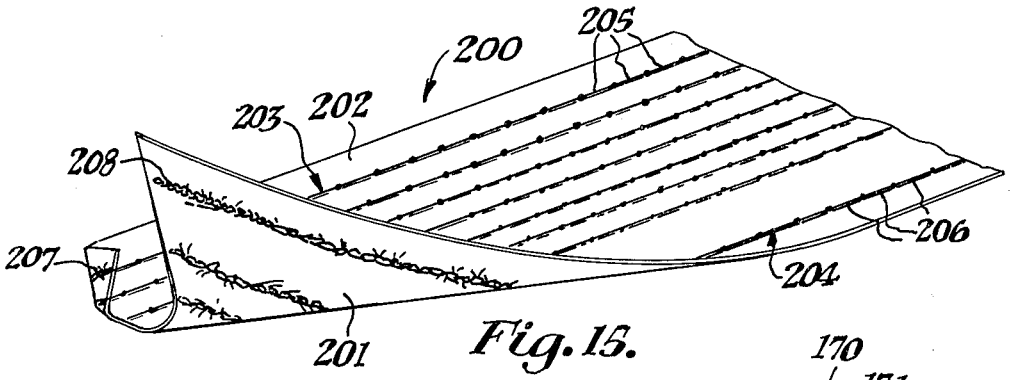
Fig. 15.
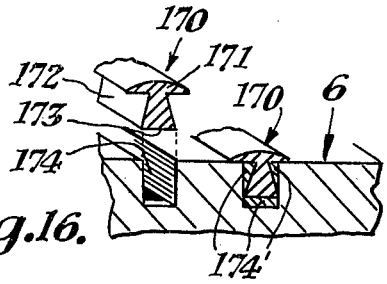
Fig. 16.

GAMING SURFACE CONTACT DETECTING SYSTEMS

This is a continuation of application Ser. No. 570,766 filed Apr. 23, 1975 abandoned.

BACKGROUND OF THE INVENTION

This invention relates generally to new and improved gaming surface contact detecting systems for detecting the presence of a particular type of projectile on the gaming surface and for locating the position of touchdown of the projectile, and more particularly, to new and improved gaming projectile surfaces and surface signaling means.

As is perhaps well known, various automatic signaling means for gaming surfaces have been designed and patented in the past. The H. K. Krist U.S. Pat. No. 3,415,517 discloses an automatic impact detector system for the game of tennis. The Peter Jokay et al patent number 3774194 discloses another type of game court boundary indicating system and illustrates sensing means connected to the gaming court.

BRIEF DESCRIPTION OF THE INVENTION

The present invention relates to improved gaming surface contact detecting systems for identifying a particular type of game projectile when the surface of the projectile makes contact with the surface signaling means. In one preferred embodiment of the invention the detecting system includes a projectile in the shape of a round ball having at least one surface portion that is electrically conductive. The ball may include metal strands that may be needle punched or woven into the fibrous material of the ball cover. In this preferred embodiment, the surface signal means includes sensing means in the form of a plurality of electrical leads overlaying the surface of at least a portion of the gaming court area and the top surface of a net, if used. The surface signal means also includes a signaling device for providing an electrical input to the generally open parallel electrical leads for providing a signal output when the leads are bridged by the conductive ball. The leads are placed on the court surface at particular known locations so that when any adjacent pairs of leads are bridged by the conductive ball, an electrical signal is transmitted along the leads. The electrical signal on the adjacent pairs of leads provides the touchdown position information of the particular ball in relation to the gaming court area or net. The electrical signal therefore is informative and verifies that the conductive ball has made contact across the leads at a particular location. The signal may be connected to a display device for converting the signal into a particular type of indication for displaying the touchdown position of the ball relative to the known position of the particular leads that transmitted the electrical signal. The display indication will extend for a period of time longer than the touchdown time of the ball.

In another embodiment, the projectile may include a chemical surface portion. The surface sensing means may include a second chemical material that provides a visual signal when brought into contact with the projectile surface. The visual signal will exist for a period of time on the gaming surface longer than the touchdown time of the ball before it fades out of existence.

It is an object of this invention to provide a surface contact detecting system for a projectile and a gaming surface area.

It is another object of this invention to provide a detecting system including a projectile having at least a portion of its surface constructed of a detectable material and a surface signal means including another detectable material overlying at least a portion of the gaming surface area or the net.

Another object of this invention is to provide a positive signal for a time period greater than the contact time of a bouncing ball on a surface or net when the surface of a projectile is placed in positive contact with a portion of a surface signal means that overlays a particular gaming surface area.

A further object of this invention is to provide a positive surface contact detecting system that can identify a gaming projectile from other surfaces that make contact with the gaming surface.

Another object of this invention is to provide a gaming ball having a surface portion of a generally known electrical conductivity for touchdown sensing purposes.

Another object of this invention is to provide a gaming ball with an outer covering having metal strands that are conductive for electrical sensing purposes.

A further object of this invention is to provide a standard gaming ball with a chemical coating for sensing purposes when the coating is brought into contact with a surface signal means.

A further object of this invention is to provide an electrically conductive coating on a projectile and electrically open leads on a gaming surface that are connected to an electrical input means to provide an electrical signal when the projectile bridges said leads.

A further object of this invention is to provide an automatic game surface contact detecting system that includes the combination of a ball with a special surface and surface signal means for providing a timed signal useful to indicate the presence and the location of the ball contacting a gaming surface area.

An additional object of this invention is to provide a tennis court surface signaling means with interconnecting leads of a particular type.

In accordance with these and other objects which will be apparent hereinafter, the instant invention will now be described with particular reference to the accompanying drawings.

BRIEF DESCRIPTION OF THE DRAWINGS

In the drawings:

FIG. 1 is a partial block diagram of the game surface contact detecting system;

FIG. 2 is a side view partially in cross-section of a projectile or ball;

FIG. 3 is a cross-section of another projectile;

FIG. 4 is an end view in cross-section of a surface signaling means in the form of a chemical layer;

FIG. 9 is an enlarged plan view of a portion of a surface signaling means in the form of electrically conductive leads in the form of wires, with the surface partially broken away to show the below surface connections;

FIG. 10 is a side view of FIG. 9 along lines D—D and looking in the direction of the arrows;

FIG. 12 is a top view illustration of leads on the top edge of the gaming net;

FIG. 13 is an isometric view of conductive connecting tapes;

FIG. 14 is a plan view of the connecting tape in place at connecting lead gaming area and a main lead connecting area;

FIG. 15 is an isometric view of metal fiber leads on an area strip;

FIG. 16 is a cross-sectional view of a cap shaped metal conductive lead on the gaming surface; and FIG. 17 is an isometric view of a gaming surface lead tester.

DESCRIPTION OF A PREFERRED EMBODIMENT

Figure 5:
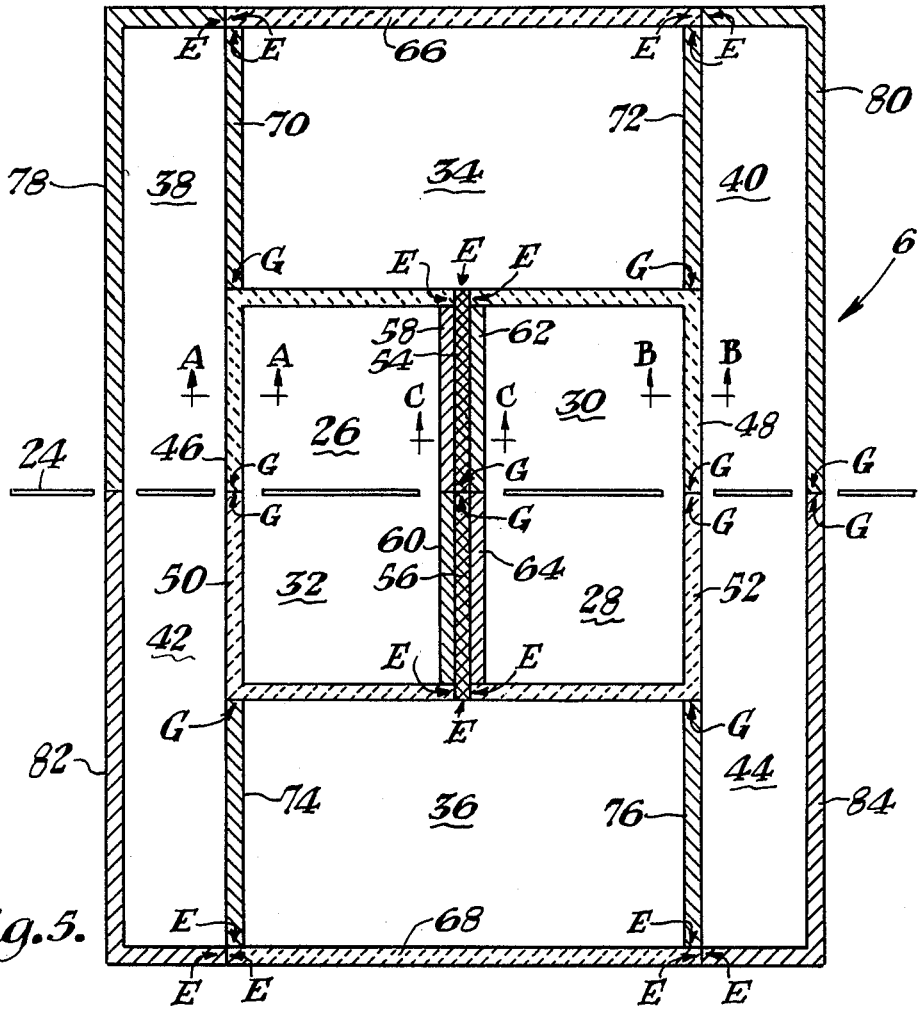
FIG. 5 is a plan view of a tennis court showing a plurality of gaming surface areas having surface signaling means thereon, the areas being wider than the tennis lines.

Referring now to the drawings, and first to FIGS. 1 and 2, the gaming surface contact detecting system 2 is used to detect the presence of a particular type of projectile 4 upon touchdown of the projectile on a gaming surface 6 as illustrated in FIG. 1, and for locating the position of touchdown of the projectile in relation to the leads 18 that may be connected to a gaming surface 6. The gaming surface may include the ground, floor, wall or net. The gaming surface contact detecting system 2 includes a projectile 4 with at least one surface portion 8 or 14 as shown in FIG. 2 and 3 of detectable material, and a surface signal means generally designated by numeral 12. The surface portion 8, such as the cover of a tennis ball, may include a detectable material that includes contact recognition surface such as an electrically conductive surface 10. Surface 10 is illustrated as a plurality of metal strands placed in the tennis ball cover by various method. The metal strands may be used as a fiber or thread would be used.

The surface signal means 12 may include a sensing means 18 shown as a plurality of electrical leads in parallel relationship. The leads form a plurality of open circuits, each alternate electrical lead is a charged hot lead and each other lead is a grounded lead. The surface contact detecting signal means may also include a signaling device 20 having an electrical input 21, connected to said sensing means 18. The sensing means 18 are exposed on and connected to at least a portion of the gaming surface 6. When the leads of the surface signal means are bridged by the projectile 4, a first signal is initiated that is of the same time duration as the touchdown time of the ball. The time duration of the first signal may be increased by the signaling device 20 a time duration that is longer than the touchdown time of the projectile 4 as it bounces off the sensing means or leads 18 on the surface of the gaming surface 6. The second signal may be used to inform a person or another electrical circuit of the ball's touchdown. A display means 22 may be connected to the signaling device 20. The display means 22 provides a display of the touchdown information for a period of time longer than the actual touchdown time of the ball.

The ball 4 shown in FIG. 2 may also utilize an alternate conductive material such as the chemical material poly vinyldibenzylmethyl ammonium chloride. The chemical material is illustrated in FIG. 2 on the cover surface as coating material 10'. The ball with coating 10' will be detected in the same manner as described above in reference to the ball having metal strands 10 on its surface.

Referring now to FIGS. 3 and 4, the projectile 4 may include a detectable chemical material 14 also referred to as the projectile surface means 14. The chemical material 14 is a first chemical material, bromophenol blue dye in lauco form. A second chemical material 16 is placed on a portion of the gaming surface 6 adjacent and over the boundary lines of a particular game as shown in FIG. 4 by numeral 7. The surface signaling means is a second chemical material 16 that may be an alkaline substance. When the first material comes in contact with the second alkaline substance a visual signal will occur. When the first and second materials are placed in contact a visual blue spot will appear at the touchdown area for a period of time that is longer than the touchdown time of the ball.

Referring now to FIG. 5 illustrating a tennis court as the gaming surface 6, the tennis court normally includes boundary lines that are under zone areas shown as hatched lines, cross-sectional lines and dashed lines. For example, the right surface courts are numbered by numerals 26 and 28. The left surface courts are numbered by numerals 30 and 32. The tennis net 24 is illustrated as partially broken so as to better illustrate the tennis court boundary lines below the net. The center line areas, wider than the centerline, are shown by cross hatched lines and numerals 54, 56, 58, 60, 62 and 64. The side service line areas and the service line areas, both of which are wider than the service lines, are shown by numerals 46, 48, 50 and 52. The back courts are designated by numerals 34 and 36. The alleys are designated by numerals 38, 40, 42 and 44. The service line areas, wider than the service lines, are on either side of the back court, designated by numerals 70, 72, 74 and 76. The base line areas of the back courts, wider than the service lines, are designated by numerals 66 and 68. The service line areas on the outside of the alleys, also wider than the service lines, are designated by numerals 78, 80, 82 and 84. The cross hatching, the cross-sectional lines and the dashed lines shown in FIG. 5 are utilized to designate the gaming area covered by the surface signaling means 12 or 16, illustrated in FIGS. 1 and 4 respectively. The surface signaling means 12 may be a chemical material 16 or electrical leads 18 that are placed on the top of the net 24 or on the gaming areas designated by numerals 46, 48, 50, 52, 54, 56, 58, 60, 62, 64, 66, 68, 70, 72, 74, 76, 78, 80, 82 and 84. The electrical leads may be wires, extruded metal forms, metal strands or other conductive material. The sensing means 18 in the form of leads are illustrated in one preferred embodiment in FIGS. 6, 7, 8, 9 and 10 as electrical wires. It should be noted that cross hatching area shown in FIG. 5 includes and extends beyond the formal tennis court center lines and service lines, as shown in the drawings, FIGS. 4, 6, 7 and 8 and illustrated by numerals 7, 46', 48' and 54' respectively.

Referring now to FIG. 1, the sensing means 18, a plurality of electrical leads are connected on top of the surface of the gaming surface 6 at various critical areas for the particular game, such as tennis, as shown in FIG. 5. The plurality of leads 18 are placed on the surface of the court, every other line is a hot line and every line between each hot line is a non-conducting or grounded line. When the ball as shown in FIG. 4 makes contact and electrically bridges two adjacent lines, an electrical signal indicating the presence of the ball will be transmitted through both adjacent lines, the formerly non-conducting line will momentarily conduct and the hot line will momentarily decrease in current and voltage. The signaling device 20 receives the signal indicative of the presence of the ball an the touchdown position. The position of the leads are known in respect to their location on the gaming court, as shown in FIG. 5, therefore the particular location of the ball is known instantaneously. The signal from the court as illustrated in FIG. 5 indicates when the ball is in play. It is obvious that the positioning of the surface signaling means 12 may in addition, be arranged to indicate when the ball is not in play.

This type of information does away with critical decisions by umpires or referees. It is difficult for an umpire or referee to make judgement calls when a speeding ball touches down on the gaming surface at great speed in a critical zone area. The speed of the ball impairs visual detection of the point of contact and thereby reduces the accuracy of the decision as to whether or not the ball is inside or outside of the particular center line or service line.

Referring now to FIGS. 1, 9 and 10, it should be noted that the leads or lines coming from the signaling device 20 are connected either under or on the top surface of the court to main wire connectors, one set of main wires is illustrated by numerals 86 and 88. The set of main wires 86 and 88 are connected to a plurality of leads 90, 91, 92, 93, 94, 95, 96 and 97 as shown in FIG. 9. Each lead and its return lead is appropriately connected to one of the main wires. The main wires are placed either under or on the surface of the court. The leads are brought from either under or on the surface of the gaming surface 6 to provide the sensing means on the gaming surface. These sensing means are the electrical leads that cover the areas shown in FIG. 5 by the various cross hatched lines, cross sectional lines and dashed lines. FIG. 10 illustrates line 97 having an undersurface connection to the main wire and an undersurface portion as illustrated by numeral 97', a surface portion illustrated by numeral 97'' and an undersurface return connecting portion illustrated by 97'''.

In FIG. 12, the top of the net 27 includes a plurality of lead lines 98, 98', 98'', 99 and 99' connected to main wires at one end of net 27 or at the bottom of the net 27, not shown. The leads on the net are spaced closer together, such as one eighth inch apart. When the projectile 4 engages two leads on the top of the net a signal will be transmitted over the leads. The signal is indicative of touchdown of the ball 4 on the top of the net. The leads may be placed on the top of the net perpendicular to the sides of the net 27' and 27''. The leads may be positioned at any angle between the position shown in FIG. 12 and the perpendicular position.

Figure 6:
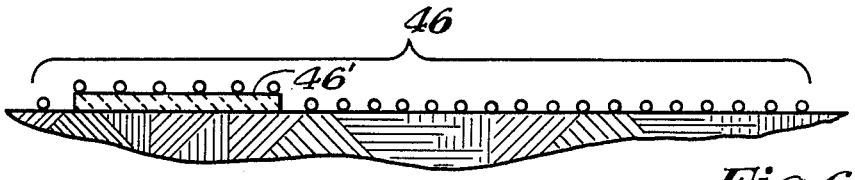
FIG. 6 is an elevation view in cross-section of FIG. 5 taken along lines A—A looking in the direction of the arrows.
Figure 7:
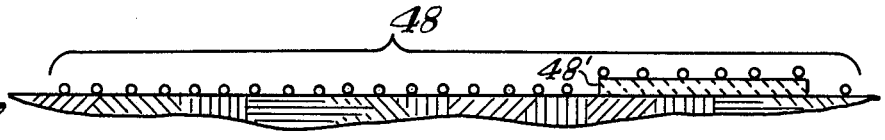
FIG. 7 is an elevation view in cross-section of FIG. 5 taken along lines B—B and looking in the direction of the arrows.
Figure 8:
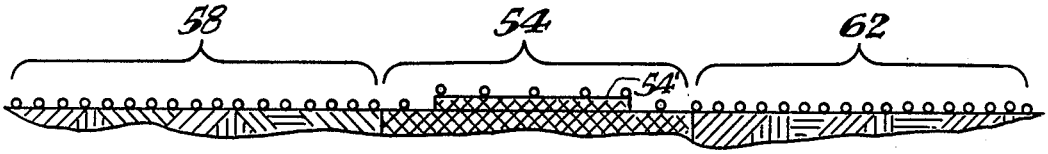
FIG 8 is an elevation view in cross-section of FIG. 5 taken along lines C—C and looking in the direction of the arrows.

Referring now to FIG. 6, 7 and 8, the sideline zone areas are illustrated in cross-section taken along lines A—A and B—B showing sidelines 46 and 48. The center line zone areas are illustrated in cross section taken along lines C—C, showing center lines 54, 58, and 62. The electrical lines or lead lines are placed on the surface of the service lines and center lines, as well as on the base line and the other critical zone areas as illustrated in FIGS. 5, 6, 7 and 8. The lead lines are also extended one line beyond the outside edges of the sidelines and baselines and both edges of the center line. The lead lines are extended inwardly a distance into the particular service court or back court or alley. It has been found that placing the lead lines approximately 8 inches inwardly from the edge of the center lines, sidelines or baselines provides an adequate detecting area for the touchdown of a projectile in critical gaming areas. The leads are placed approximately three eighths inch apart as illustrated and include 19 leads inward of the sidelines, baselines and centerlines.

A plurality of hot lines and grounded lines lie on the surface of the gaming surface 6, as shown in FIG. 5. Each line is generally parallel to the other adjacent lines. A ground line lies between each pair of hot lead lines. The hot lead lines and the grounded lines are connected as set forth herein. The interconnecting portions of the lead lines are either under or on the surface in the areas generally designated by letter E as shown in FIGS. 5, 9 and 10. The other ends of the lead lines are also placed either under or on the surface for connecting the lead lines to main leads or wires. The main leads connection area is generally designated by the letter G.

In FIG. 16 a cross section of a wire of a particular shape is shown. The long wire 170 includes a head 171 having a small height of 0.010 inch. The neck 172 is narrow in width. The base 173 is enlarged. To install wires 170, grooves 174 are cut into the gaming surface. The wires 170 are placed in the groove 174 and thereafter filled with the same material as the gaming surface or with an adhesive material to prevent removal of the shaped wire. The enlarged top prevents the wire from moving down and the enlarged base prevents upward movement of the wire.

Tapes, printed circuits and metal fiber in thread form may also be used instead of round wires or shaped wires. Referring now to FIG. 15, a thin plastic sheet of material 200 is shown and may be used to form the zone areas shown in FIG. 5. The bottom 201 of the plastic strip or sheet 200 may include adhesive material for binding the strip onto the gaming surface of the tennis court. It should be noted that other methods may be used to secure the strip onto the gaming surface 6 as shown in FIG. 5. Referring again to FIG. 15, showing the plastic strip 200 in isometric form in order to illustrate both the top of the strip 202 and the bottom of the strip 201. This illustration only shows a few parallel lines formed by stitching metal fiber threads. Only a few lines are shown to illustrate the plurality of lines that will be used in the zone areas as set forth hereinabove. The metal fiber threads 203 and 204 are stitched into the plastic sheet providing an upper electrically conductive lead surface 203 and 204 with individual thread runs numbered 205 and 206. It should be noted that the bottom of the plastic strip 200 includes the bottom portion of the threads shown by numerals 207 and 208. It should be noted if any one of the loops is broken on the top surface, the electrical lead will still conduct because of the interconnection of the threads along the bottom surface of the plastic strip. The strip 200 may be made of any comparable and suitable material that does not change the bounce of the particular ball, such as a tennis ball, when it hits the strip. The intent is to keep the same rebounding effect on the tennis ball when it hits the strip 200 as the ball will make when it contacts the gaming surface.

Referring now to FIG. 13 illustrating a tape connecting means for lead junctions and FIG. 14 illustrating electrical leads 175, 177 to 185,, 175' and 177' to 185' at a zone area junction, the flat tape connecting means 191 is used to electrically interconnect all the hot leads at the junction and to interconnect all the ground leads at the junction. The solid electrically conductive tape 186 which may be a copper strip, is adhesively connected to plastic member 189 by adhesive coating or plastic member 189. The plastic member 189 has adhesive on its bottom side. The conductive tape 186 is coated with a conductive adhesive on its bottom side as shown in FIG. 13. A second plastic member 193 has a plurality of spaced holes or connecting openings 192 therein. The holes are spaced apart three fourths inch, a distance equal to the spacing between the parallel hot leads and the parallel ground leads. The second member 193 has adhesive on its lower surface. Leads 175, 178, 180, 182 and 184 are connected to leads 184', 182', 180', 178' and 175' by using tape 176 and 176''. Leads 177, 179, 181, 183 and 185 are connected to leads 185', 184', 181', 179' and 177' by using tape connecting means 176' and 176'''. This allows fast connection to be made between all hot leads and a fast connection between all grounded leads. The tape connection means shown in FIG. 14 is shown with the upper material 189 and the copper strip 186 removed. The copper strip, when in place, will conduct electricity between each lead exposed by the holes in the second member 193. The connections just described may be made at the junctions within the same zone as shown in FIG. 5 in zone 78, 46 etc. It should be noted that these tape connecting means may also be used to connect each of the leads to the main lead that is connected to the signaling device 20, shown in FIG. 1. The copper strips 211 and 214 are shown in FIG. 14 connected as main leads. The copper strips are connected to the hot leads and grounded leads through holes in second members 212 and 215 of tape connecting means 210 and 213.

Referring now to FIG. 17, showing a conductive wheel 209 that is rotatable on axis 210 that is in turn connected to the handle 211. This metal wheel may be utilized as a testing means to test the leads on the zone areas on the gaming surface. In use the wheel is rolled over the leads in order to make and break contact between a hot lead and a ground lead. This movement will show whether or not the particular lead on the zone of the gaming surface is properly connected and responsive to the movement of a conductive ball. The diameter of the wheel 209 is approximately the same diameter of the ball being used on the gaming surface.

Figure 11:
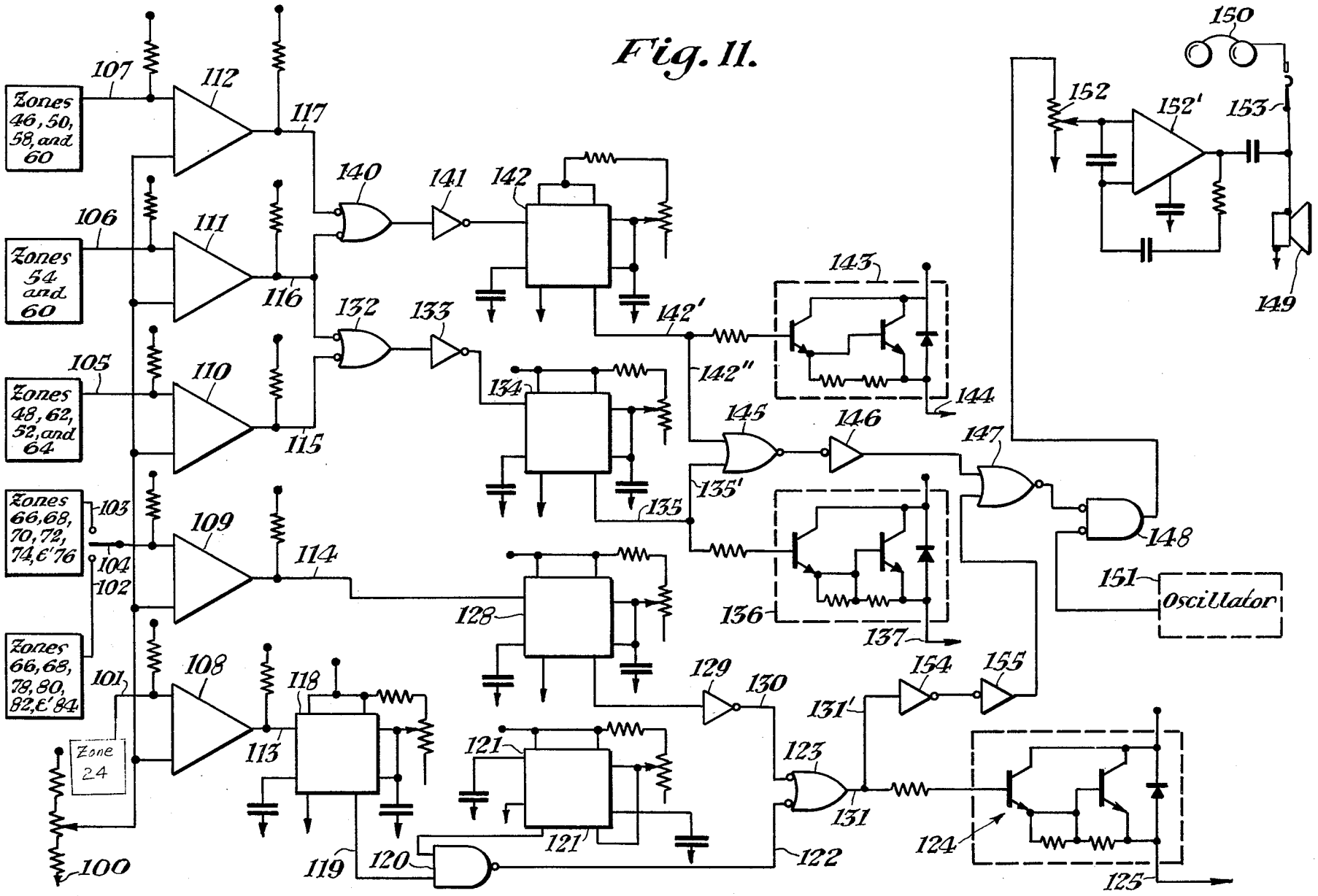
FIG. 11 is a schematic diagram showing the game surface contact detecting system as illustrated in partial block form in FIG. 1.

Referring generally to FIG. 5 and 11, the hot leads in each of the critical zones are connected to the main leads at the points marked by the letter G in FIG. 5. The hot lines are connected to particular input lines 101, 102, 103, 105, 106 and 107 in the signaling device circuit that is shown in FIG. 11. The grounded lead lines are connected to ground leads designated by numeral 100 in FIG. 11. The hot lines on the net are connected to input 101. The hot lines from zones 66, 68, 78, 80, 82 and 84 are interconnected to main leads that are in turn connected to the input 102 in FIG. 11. The hot lines in zones 66, 68, 70, 72, 74 and 76 are connected to input 103 in FIG. 11. Switch 104 is either connected to input 102 or input 103. Switch 104 connects input 102 to comparator 109 when double tennis matches are played. Switch 104 connects input 103 to comparator 109 when single matches are played. The hot lines from L-shaped zones 48, 52 and zones 62 and 64 are connected to input 105. The hot lines from zone 54 and 56 are connected to input line 106. The hot lines from L-shaped zones 46, 50 and zones 58 and 60 are connected to input line 107.

When a decrease in voltage appears at input line 107, the signaling device 20 will actuate a signal transmitted to the display means 22 to actuate a green light 138 on the display means 22, shown in FIG. 1. The green light shows that the ball is in play within bounds on the tennis court after the ball is served. When there is a decrease in voltage at input line 106 in FIG. 11, the signaling device 20 will actuate a signal transmitted to the display means 22 to actuate two green lights 138 and 139 in display means 22, showing that the ball is in play within bounds on the tennis court when the ball is served. When there is a decrease in voltage at input line 105, in FIG. 11, the signaling device 20 will actuate the display means 22 to actuate the green light 139. When there is a decrease in voltage at input lead 103 or 102, depending on the position of switch 104, the signaling device 20 will actuate the display means to actuate two red lights 126 and 127. When there is a decrease in voltage at input 101, the signaling device 20 will actuate the display means to provide two blinking red lights 126 and 127. Whenever a decrease in voltage occurs at the inputs 101, 102, 103, 105, 106 or 107 the signaling device 20 may actuate an audio sound associated with the signaling device 20 or the display means 22.

Each comparator 108, 109, 110, 111 and 112 is connected to the input 101 through 104, input 105, input 106, input 107 and to ground 100. Pull up resistors are connected between each input and comparator, as shown in FIG. 11. When a decrease in voltage comes through the input to the comparator, the comparator compares the drop in voltage with a set threshold voltage. The set threshold voltage may be adjustable. If the voltage drop is below the threshold voltage the comparator forwards an output signal.

For example, when adjacent lead lines on the net are bridged by the conductive ball a signal passes through input 101 to comparator 108, the output signal of the comparator 108 is forwarded along line 113 into adjustable timer 118. The timer 118 provides a signal of a particular time duration that is longer than the touchdown signal initiated by the ball bridging at least two net lead lines. The timed signal from timer 118 is transmitted along lines 119 to the AND gate 120. Timer 121 is wired like a multi-vibrator and is continuously operated to provide a pulse or cyclic output signal that is transmitted to the AND gate 120. The pulsed or cyclic output of AND gate 120 is transmitted along line 122 to OR gate 123 for the time duration controlled by timer 118. The signal is transmitted from OR gate to the NPN Darlington Pair, a lamp driver 124. The cyclic output of the lamp driver 124 is transmitted over line 125 to both of the red lamps 126 and 127 in FIG. 11 to provide a flashing red output signal.

When a decrease in voltage is transmitted to the input 102 or 103 and across switch 104 to comparator 109, an output signal is transmitted after the comparator senses that a proper input was received. The comparator output signal moves along lines 114 through adjustable timer 128 and on through inverter 129 and along line 130 to the OR gate 123. The OR gate output signal is transmitted along line 131 to the lamp driver 124. The output of the driver 124 is transmitted along line 125 to light both red lamps 126 and 127 continuously for the time period controlled by timer 128.

When a drop in voltage appears across input 105 because a ball has bridged the gap between adjacent lead lines the comparator 110 provides an output signal that is transmitted along line 115 into the NOR gate 132. The NOR gate forwards the signal on through the inverter 133 and into the adjustable timer 134. The output from adjustable timer 134 passes across line 135 into the lamp driver 136. The lamp driver 136 passes a signal output along line 137 to green light 139 in order to light the lamp.

When a proper decrease in voltage appears across the input 106, the comparator 111 produces an output signal that is transmitted along line 116 to both the NOR gates 132 and 140. The outputs of the NOR gates 132 and 140 are transmitted through inverters 133 and 141 respectively and into the adjustable timers 134 and 142 respectively. The timers 134 and 142 provide an output transmitted along lines 135 and 142' respectively to actuate the lamp drivers 136 and 143 respectively. The outputs from the lamp driver 137 and 144 are transmitted along lines 137 and 144 respectively to light both green lights 139 and 138 at the same time.

When a proper decrease in voltage occurs across input 107 the comparator 112 will pass an output signal along line 117 through NOR 140 and on through inverter 141 to the adjustable timer 142. The output of the adjustable timer 142 will pass through line 142' into the lamp driver 143 to provide a signal transmitted along line 144 to drive green lamp 138. The lamp is on for the time duration set in the adjustable timer.

Resistors are connected to lines 113 through 117 as shown in FIG. 11 to prevent stray oscillations. The comparators may be of the LN311 type. The adjustable timers may be of the 555 type. The NOR gates may be of the 4001 type. The AND gate 120 may be of the 4001 type. The OR gate 123 may be of the 4011 type and the OR gates 145 and 147 may be of the 4011 type. The AND gate 148 may be of the 4011 type. The lamp drivers may be of the MJ300 type.

Each of the input circuits may be connected to an audio circuit for producing an audio sound through the speaker 149 or through ear phones 150. The input 107, 106 and 105 are connected to the audio means through lines 135' and 142" to OR gate 145. The output of an OR gate 145 is transmitted through inverter 146 and on to the OR gate 147. The output of the OR gate 147 is transmitted to AND gate 148. The other side of the AND gate 148 is connected to the continuously operated oscillator 151. The output of OR gate 148 is transmitted to the volume control 152 and audio amplifier 152'. The audio amplifier 152' is connected to the speaker 149 or to the jack 153. Earphones 150 may be connected to jack 153. The input from input lines 101, 102 and 103 are connected to the audio device through line 131' that passed the signal through two inverters 154 and 155 and then to the OR gate 147. The signal from the OR gate 147 is transmitted to AND gate 148 and on to the audio amplifier 152' to provide an audio signal.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An electrical detecting system comprising:

electrically conductive sensing means adapted to be positioned in at least one pre-selected zone on a tennis court or other playing surface a ball for contacting said sensing means and having an electrically conductive coating of poly vinyldibenzylmethyl ammonium chloride on its outer surface, and means connected to said sensing means for signalling touchdown of said ball in said at least one zone in response to the contact of the ball's electrically conductive coating with said sensing means.

2. An electrical in-ball indicator system for indicating touchdown of a ball in one or more selected zones on a tennis court playing surface or other playing surface having one or more court lines wherein the court lines bound a playing surface area, wherein each court line has a pre-selected width, and wherein said ball is provided with electrically conductive means on its outer periphery, said electrical in-ball indicator system comprising at least one electrically operated indicator, a sensing circuit having a group of exposed, spaced apart, generally parallel conductors disposed on said playing surface in at least one of said zones and extending lengthwise of at least one of said court lines, and electrical circuit means connected to said sensing circuit and said indicator to operate said indicator in response to touchdown of said ball at a place where the electrically conductive means on said ball completes a current-conducting circuit across adjacently disposed ones of said conductors in said sensing circuit, only one of said conductors in said sensing circuit being disposed out bounds of the playing surface area delimited by the outer edge of said one of said court lines, and the remainder of said conductors in said sensing circuit being disposed in bounds of the playing surface area delimited by the outer edge of said one of said court lines.

3. An electrical indicator system for indicating touchdown of a ball in one or more selected zones on a tennis court playing surface or other playing surface area, wherein said ball is provided with electrically conductive means on its outer periphery, said electrical indicator system comprising at least one electrically operated indicator, a sensing circuit having a group of exposed, spaced apart, generally parallel conductors disposed on said playing surface in at least one of said zones, and an electrical circuit connected to said sensing circuit and said indicator and including means for producing an electrical pulse in response to the completion of a current-conducting circuit across adjacently disposed ones of said conductors by contact of the electrically conductive means on said ball with said conductors, the duration of said electrical pulse being determined by the time period that said electrically conductive means is in contact with said conductors, and said electrical circuit further including means responsive to said electrical pulse for causing continuous operation of said indicator throughout a pre-selected time interval to indicate touchdown of said ball on said sensing circuit, said pre-selected time interval being independent of the duration of said electrical pulse.

4. An electrical indicator system for indicating touchdown of a tennis ball in one or more selected zones on a tennis court playing surface having court lines, wherein said ball is provided with electrically conductive means on its outer periphery, said electrical indicator system comprising at least one electrically operated indicator, a sensing circuit having a group of exposed, spaced apart, generally parallel conductors extending lengthwise of at least one of said court lines, with at least a plurality of said conductors being disposed on said one of said court lines, electrical circuit means connected to said sensing circuit and to said indicator to operate said indicator in response to touchdown of said ball at a place where the electrically conductive means on said ball completes a current-conducting circuit across adjacently disposed ones of said conductors, said electrical circuit means including a source of electric power, and connecting means electrically connecting said source to said conductors, said connecting means comprising an electrical connector unit for electrically connecting alternate ones of said conductors together, and said connector unit comprising a strip of electrically non-conductive material extending transversely of and overlying said conductors and having openings registering with portions of only alternate ones of said conductors, and an electrical conductor means disposed on the upwardly facing side of said strip and extending across said openings to make electrical contact with the conductor portions that are exposed through said openings.

5. An electrical in-ball indicator system for indicating touchdown of a tennis ball in one or more selected zones on a tennis court playing surface having one or more court lines wherein the court lines bound a playing surface area wherein each court line has a preselected width, and wherein said ball is provided with electrically conductive means on its outer periphery, said electrical in-ball indicator system comprising a least one electrically operated indicator, a sensing circuit having a group of exposed, spaced apart, generally parallel conductors disposed on said playing surface in at least one of said zones and extending lengthwise of at least one of said court lines, and electrical circuit means connected intermediate said sensing circuit and said indicator to operate said indicator in response to touchdown of said ball at a place where the electrically conductive means on said ball completes a current-conducting circuit across adjacently disposed ones of said conductors in said sensing circuit, only one of said conductors in said sensing circuit being disposed out bounds of the playing surface area delimited by the outer edge of said one of said court lines, and the remainder of said conductors in said sensing circuit being disposed in bounds of the playing surface area delimited by the outer edge of said one of said court lines.

6. An electrical indicator system for indicating touchdown of a tennis ball in one or more selected zones on a tennis court playing surface having court lines, wherein said ball is provided with electrically conductive means on its outer periphery, said electrical indicator system comprising at least one electrically operated indicator, a sensing circuit having a group of exposed, spaced apart, generally parallel conductors extending lengthwise of at least one of said court lines, with at least a plurality of said conductors being dispsoed on said one of said court lines, electrical circuit means connected intermediate said sensing circuit and said indicator to operate said indicator in response to touchdown of said ball at a place where the electrically conductive means on said ball completes a current-conducting circuit across adjacently disposed ones of said conductors, said electrical circuit means including a source of electric power, and connecting means electrically connecting said source to said conductors, said connecting means comprising an electrical connector unit for electrically connecting alternate ones of said conductors together, and said connector unit comprising a strip of electrically non-conductive material having upwardly and downwardly facing sides and extending transversely of said conductors, said strip having openings registering with portions of only alternate ones of said conductors, said portions of said alternate ones of said conductors being disposed on one of said sides of said strip, and an electrical conductor means disposed on the other of said sides of said strip and extending across said openings to make electrical contact with the conductor portions that are exposed through said openings.

* * * * *